US010667666B2

(12) United States Patent
Hinojosa

(10) Patent No.: US 10,667,666 B2
(45) Date of Patent: Jun. 2, 2020

(54) DEVICE FOR CATCHING DEBRIS FROM COUNTERTOP

(71) Applicant: Innovative Synergies, LLC, Arlington, TX (US)

(72) Inventor: Roel E. Hinojosa, Arlington, TX (US)

(73) Assignee: INNOVATIVE SYNERGIES, LLC, Arlington, TX (US)

( * ) Notice: Subject to any disclaimer, the term of this patent is extended or adjusted under 35 U.S.C. 154(b) by 94 days.

(21) Appl. No.: 15/973,180

(22) Filed: May 7, 2018

(65) Prior Publication Data

US 2019/0335972 A1 Nov. 7, 2019

(51) Int. Cl.
*A47L 13/52* (2006.01)
*A47L 13/10* (2006.01)

(52) U.S. Cl.
CPC ..... *A47L 13/52* (2013.01); *A47L 13/10* (2013.01)

(58) Field of Classification Search
CPC ..... A47L 13/52; A47L 13/10
See application file for complete search history.

(56) References Cited

U.S. PATENT DOCUMENTS 473,004 A * 4/1892 Hull ..... A47L 13/52 15/257.4
2,987,749 A * 6/1961 Gortner ..... A47L 13/52 15/257.7
3,345,670 A * 10/1967 Charie ..... E01H 1/1206 15/257.1
3,562,840 A * 2/1971 Meszaros ..... A47L 13/52 15/257.4
4,796,938 A * 1/1989 Knights ..... A01G 20/30 294/178
4,809,390 A * 3/1989 Jackson ..... A47L 13/52 15/257.1
D339,437 S * 9/1993 Hinderer ..... D32/74
5,425,153 A * 6/1995 Vosbikian ..... A47L 13/52 15/257.2
5,473,790 A * 12/1995 Desmarais ..... A47L 13/52 15/257.7
6,892,419 B1 * 5/2005 Duprey ..... A47L 13/52 15/257.1
7,171,719 B1 * 2/2007 Harrelson ..... A47L 13/52 15/257.1
8,714,607 B1 * 5/2014 Suber ..... A01B 1/02 294/50
8,844,091 B1 * 9/2014 Troyer ..... A47L 13/11 15/104.8
2004/0134004 A1 * 7/2004 Kaleta ..... A47L 13/52 15/104.002

* cited by examiner

*Primary Examiner* — Michael D Jennings
(74) *Attorney, Agent, or Firm* — Wick Phillips Gould & Martin LLP

(57) ABSTRACT

Embodiments of the disclosure include a device for catching debris may comprise a flat surface for holding debris; a retaining wall surrounding the flat surface and extending vertically from the flat surface, configured to restrict movement of the debris beyond portions of the flat surface; a rigid counter guide configured to fit against a countertop while at least a portion of the flat surface extends below the countertop, wherein the rigid counter guide allows a user to push the retaining wall and the portion of the flat surface against the countertop; and a handle attached to the flat surface at an opposite end from the rigid counter guide, wherein the handle is shaped to fit a hand of a user.

17 Claims, 7 Drawing Sheets

DEVICE FOR CATCHING DEBRIS FROM COUNTERTOP

CROSS-REFERENCE TO RELATED APPLICATIONS

Not applicable.

BACKGROUND

The invention relates to a device for manual collection of debris, having a handle attached to a flat surface onto which debris can be swept for disposal. Debris produced in a kitchen, garage, bathroom, workshop, and other domestic or industrial locations may collect on countertops. It may be difficult to effectively remove the debris from the countertop without causing some of the debris to fall to a floor below the countertop.

SUMMARY

In an embodiment of the disclosure, a device for catching debris may comprise a flat surface for holding debris; a retaining wall surrounding the flat surface and extending vertically from the flat surface, configured to restrict movement of the debris beyond portions of the flat surface; a rigid counter guide configured to fit against a countertop while at least a portion of the flat surface extends below the countertop, wherein the rigid counter guide allows a user to push the retaining wall and the portion of the flat surface against the countertop; and a handle attached to the flat surface at an opposite end from the rigid counter guide, wherein the handle is shaped to fit a hand of a user.

In another embodiment of the disclosure, a method of manufacturing a device for catching debris from a countertop may comprise forming a flat surface for supporting debris; attaching a retaining wall to at least a portion of the outer edge of the flat surface, extending perpendicular to the flat surface; forming a rigid counter guide at an end surface of the retaining wall, wherein at least a portion of the flat surface extends past the rigid counter guide; attaching a handle to the flat surface or retaining wall at an opposite end from the rigid counter guide, wherein the handle is shaped to fit a hand of a user.

In yet another embodiment of the disclosure, a device for catching debris from a countertop may comprise a flat surface comprising an approximately rectangular shape; a retaining wall extending from at least three of four sides of the flat surface and extending perpendicular to the flat surface, configured to prevent debris from moving beyond the flat surface; a first rigid counter guide located at an end surface of the retaining wall, wherein at least a portion of the flat surface extends past the first rigid counter guide; and a second rigid counter guide located at another end surface of the retaining wall, wherein at least a portion of the flat surface extends past the second rigid counter guide.

DETAILED DESCRIPTION

Unless defined otherwise, technical and scientific terms used herein have the same meaning as commonly understood by one of ordinary skill in the art to which the claimed material belongs. The following terms are defined below.

Embodiments of the disclosure include a device for catching debris from a countertop or other similar surface, and methods of manufacture and use of the device. The device may comprise a large (approximately flat) surface configured to hold debris that may be swept onto or into the device by a user. The device may also comprise a retaining wall surrounding at least a portion of the large surface, and the device may comprise one or more rigid counter guides configured to contact a countertop while the device is in use. The rigid counter guide(s) may allow a user to press the device flush against a countertop, allowing a user to sweep or otherwise move debris from the countertop on the device, while preventing the debris from falling to a floor below the countertop.

Figure 1:
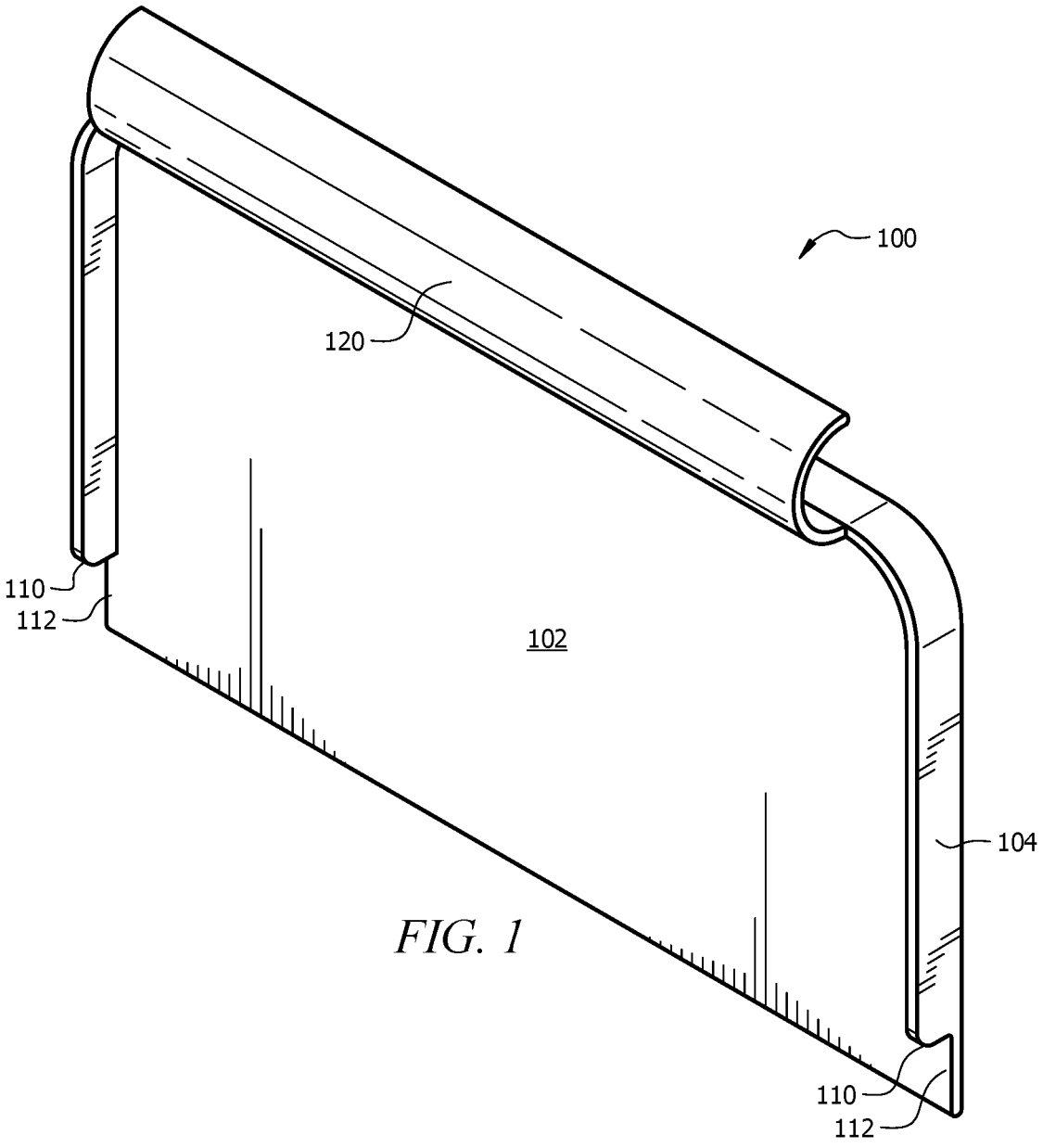
FIG. 1 illustrates a perspective view of a device for catching debris from a countertop according to an embodiment of the disclosure.

Referring to FIG. 1, a device 100 is shown comprising a flat surface 102 and a retaining wall 104 surrounding the flat surface 102. In the embodiment shown in FIG. 1, the flat surface 102 may be substantially flat. In some embodiments, the flat surface 102 may comprise other shapes, surface features, and/or textures that may facilitate retaining of debris from moving beyond the flat surface. In the embodiment shown in FIG. 1, the retaining wall 104 may extend from three of four sides of the flat surface 102, and may be attached to and/or formed onto the outer edge of the flat surface 102. In some embodiments, the retaining wall 104 may extend approximately 10 millimeters from the flat surface 102.

In the embodiment shown in FIG. 1, the device 100 may comprise a handle 120, which may be attached to the retaining wall 104, incorporated into the retaining wall 104, and/or attached to the flat surface 102. The handle 120 may comprise a rounded shape configured to fit the hand of a user. In some embodiments, the handle 120 may extend along one of four sides of the flat surface 102. In some embodiments, the handle 120 may extend along the majority of the length of the one side of the flat surface 102. In some embodiments, the handle 120 may comprise a half-cylinder shape.

In the embodiment shown in FIG. 1, the device 100 may comprise at least one rigid counter guide 110. In some embodiments, the rigid counter guide 110 may be formed by an end surface of the retaining wall 104. In some embodiments, the rigid counter guide 110 may comprise a first rigid counter guide and a second rigid counter guide, where the first rigid counter guide may be located at a first end surface of the retaining wall 104, and the second rigid counter guide may be located at a second end surface of the retaining wall 104. In the embodiment shown in FIG. 1, a portion 112 of the flat surface 102 may extend past the rigid counter guide 110, where the retaining wall 104 may not be attached to the portion 112 of the flat surface 102. In some embodiments, the rigid counter guide 110 may be located on a side of the flat surface 102 opposite from the handle 120. In use, the portion 112 of the flat surface may extend below a countertop, while the rigid counter guide 110 contacts a side of the countertop, allowing the device 100 to fit flush with the countertop and preventing any spaces between the device 100 and the countertop where debris may fall outside of the flat surface 102.

Figure 2:
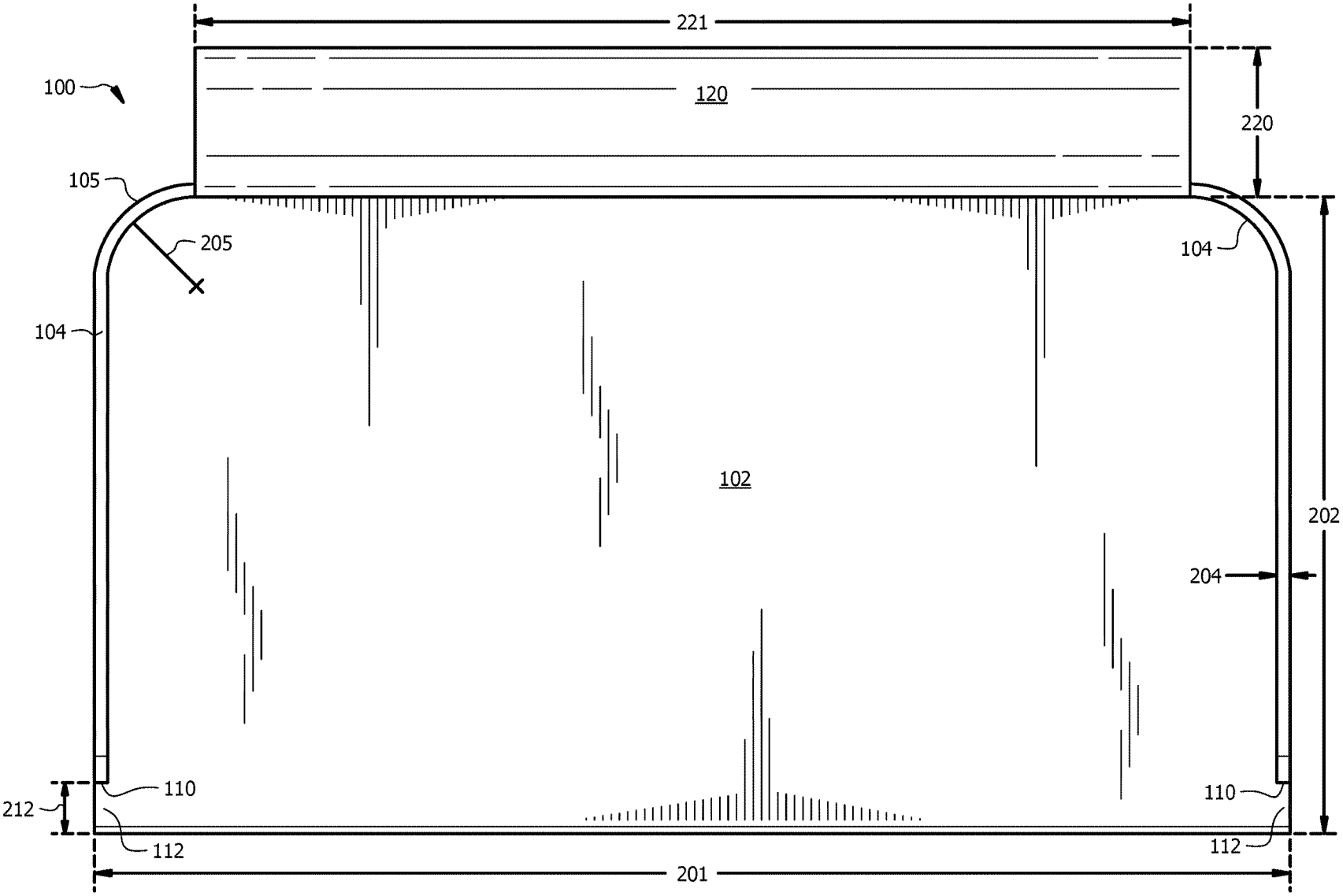
FIG. 2 illustrates a front view of a device for catching debris from a countertop according to an embodiment of the disclosure.

Referring to FIG. 2, the flat surface 102 may comprise a length 201 of between approximately 100 mm and 500 mm. In some embodiments, the flat surface 102 may comprise a length 201 of approximately 300 mm. In some embodiments, the flat surface 102 may comprise a width 202 of between approximately 50 mm and 250 mm. In some embodiments, the flat surface 102 may comprise a width 202 of approximately 160 mm. In some embodiments, the retaining wall 104 may comprise a thickness 204 between approximately 2 mm and 10 mm. In some embodiments, the retaining wall 104 may comprise a thickness 204 of approximately 3 mm. In some embodiments, the thickness 204 of the retaining wall 104 may also be the thickness of the rigid counter guide 110.

In some embodiments, the retaining wall 104 comprise at least one curved portion 105, possibly located proximate to the handle 120. In some embodiments, the curved portion 105 of the retaining wall 104 may comprise a radius 205 of between approximately 10 mm and 30 mm. In some embodiments, the curved portion 105 of the retaining wall 104 may comprise a radius 205 of approximately 22 mm. In some embodiments, the portion 112 of the flat surface 102 that extends beyond the rigid counter guide 110 may comprise a depth 212 between approximately 5 mm and 25 mm. In some embodiments, the portion 112 of the flat surface 102 that extends beyond the rigid counter guide 110 may comprise a depth 212 of approximately 12 mm. In some embodiments, the handle 120 may comprise a width 220 between approximately 20 mm and 50 mm. In some embodiments, the handle 120 may comprise a length 221 between approximately 150 mm and 350 mm. In some embodiments, the handle 120 may comprise a width 220 of approximately 38 mm, and a length 221 of approximately 250 mm.

In some embodiments, the ratio of the length 201 of the flat surface 102 to the width 202 of the flat surface 102 may be between approximately 1:1 and 3:1. In some embodiments, the ratio of the length 201 of the flat surface 102 to the width 202 of the flat surface 102 may be approximately 2:1. In some embodiments, the ratio of the length 201 of the flat surface 102 to the width 202 of the flat surface 102 may be approximately 1.8:1. In some embodiments, the ratio of the length 201 of the flat surface 102 to the width 202 of the flat surface 102 may be approximately 1.5:1.

In some embodiments, the ratio of the width 202 of the flat surface 102 to the width 220 of the handle 120 may be between approximately 3:1 and 6:1. In some embodiments, the ratio of the width 202 of the flat surface 102 to the width 220 of the handle 120 may be approximately 5:1. In some embodiments, the ratio of the width 202 of the flat surface 102 to the width 220 of the handle 120 may be approximately 4:1. In some embodiments, the ratio of the width 202 of the flat surface 102 to the width 220 of the handle 120 may be approximately 4.25:1. In some embodiments, the ratio of the width 202 of the flat surface 102 to the width 220 of the handle 120 may be approximately 3:1.

In some embodiments, the ratio of the length 201 of the flat surface 102 to the length 221 of the handle 120 may be between approximately 1:1 and 3:1. In some embodiments, the ratio of the length 201 of the flat surface 102 to the length 221 of the handle 120 may be approximately 2:1. In some embodiments, the ratio of the length 201 of the flat surface 102 to the length 221 of the handle 120 may be approximately 1.5:1. In some embodiments, the ratio of the length 201 of the flat surface 102 to the length 221 of the handle 120 may be approximately 1.2:1.

In some embodiments, the ratio of the total width 202 of the flat surface 102 to the depth 212 of the portion 122 of the flat surface may be between approximately 5:1 and 20:1. In some embodiments, the ratio of the total width 202 of the flat surface 102 to the depth 212 of the portion 122 of the flat surface may be approximately 12:1. In some embodiments, the ratio of the total width 202 of the flat surface 102 to the depth 212 of the portion 122 of the flat surface may be approximately 10:1.

Figure 3:
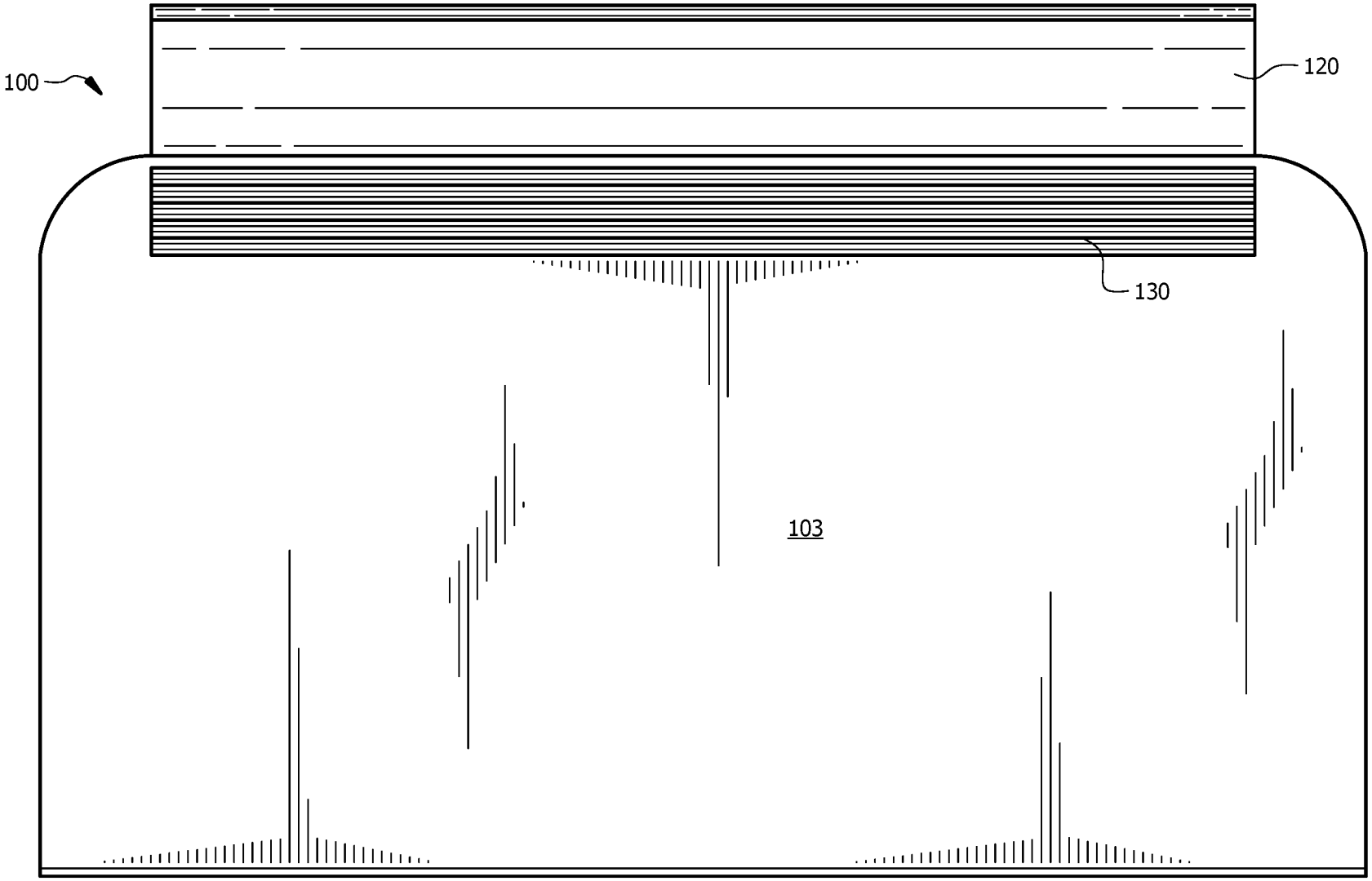
FIG. 3 illustrates a rear view of a device for catching debris from a countertop according to an embodiment of the disclosure.

Referring to FIG. 3, a back view of the device 100 illustrates a plurality of ridges 130 located on a back side 103 of the flat surface 102 (shown above). The ridges 130 may be located proximate to the handle 120, and may be configured to provide a gripping surface for a user's hand and fingers as they are holding the handle 120.

Figure 4:
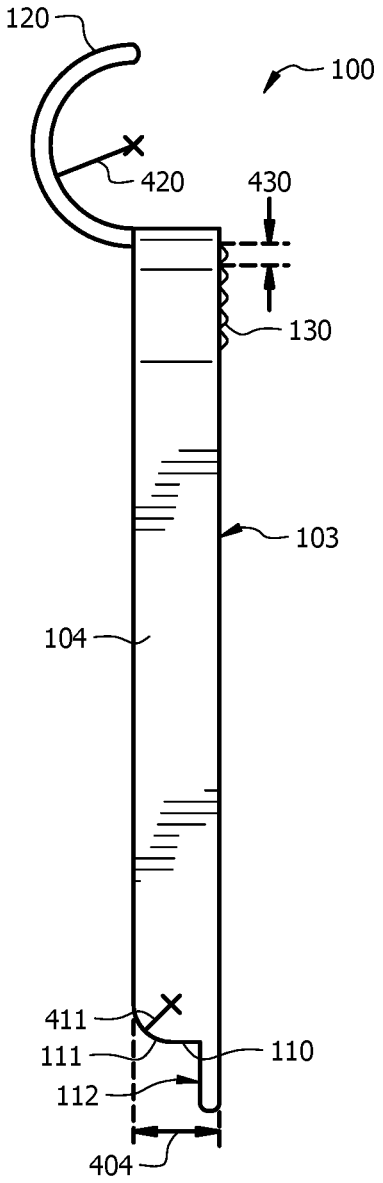
FIG. 4 illustrates a first side view of a device for catching debris from a countertop according to an embodiment of the disclosure.
Figure 5:
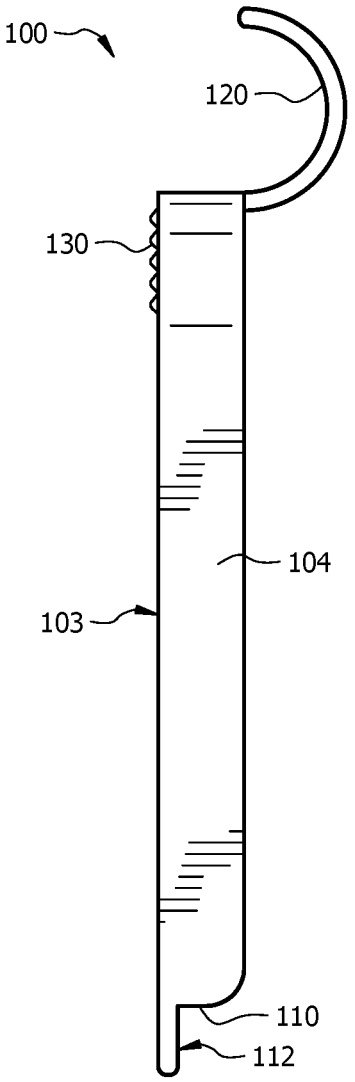
FIG. 5 illustrates a second side view of a device for catching debris from a countertop according to an embodiment of the disclosure.

Referring to FIG. 4 and FIG. 5, side views of the device 100 are shown. In some embodiments, the retaining wall 104 may comprise a height 404 between approximately 5 mm and 30 mm. In some embodiments, the retaining wall 104 may comprise a height 404 of approximately 15 mm. In some embodiments, the height 404 of the retaining wall 104 may also be the height of the rigid counter guide 110. In some embodiments, the ratio of the height 404 to the thickness 204 of the retaining wall 104 may be between approximately 3:1 and 6:1. In some embodiments, the ratio of the height 404 to the thickness 204 of the retaining wall 104 may be approximately 5:1.

In some embodiments, the retaining wall 104 may comprise a curved edge 111 located proximate to the rigid counter guide 110, and the curved edge 111 may comprise a radius 411 between approximately 2 mm and 10 mm. In some embodiments, the curved edge 111 may comprise a radius 411 of approximately 6 mm. In some embodiments, the handle 120 may comprise an approximately circular shape, and may comprise a radius 420 between approximately 5 mm and 30 mm. In some embodiments, the handle 120 may comprise a radius 420 of approximately 15 mm. In some embodiments, a ridge of the plurality of ridges 130 may comprise a width 430 between approximately 1 mm and 10 mm. In some embodiments, a ridge of the plurality of ridges 130 may comprise a width 430 of approximately 4 mm. In some embodiments, the plurality of ridges 130 may comprise at least four ridges. In some embodiments, the plurality of ridges 130 may comprise between two and ten individual ridges.

Figure 6:
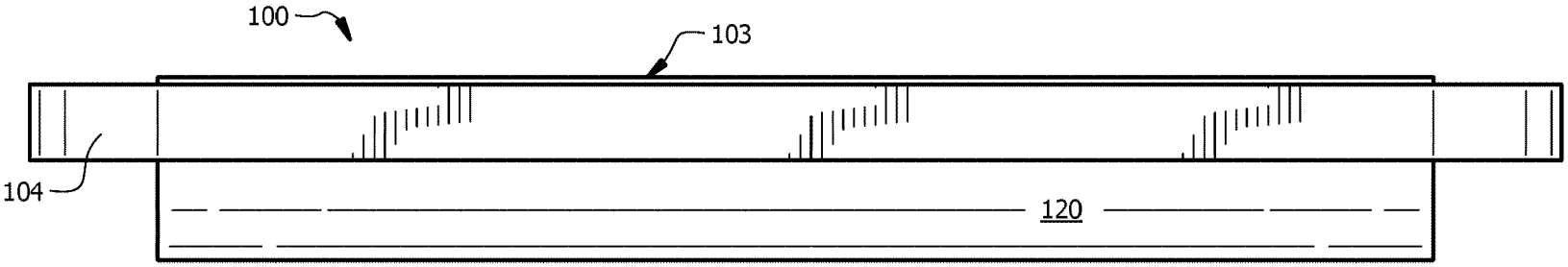
FIG. 6 illustrates a top view of a device for catching debris from a countertop according to an embodiment of the disclosure.
Figure 7:
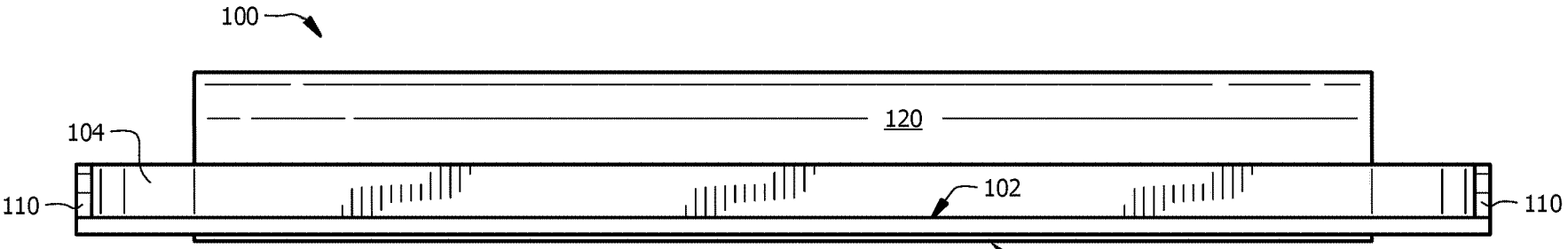
FIG. 7 illustrates a bottom view of a device for catching debris from a countertop according to an embodiment of the disclosure.
Figure 8:
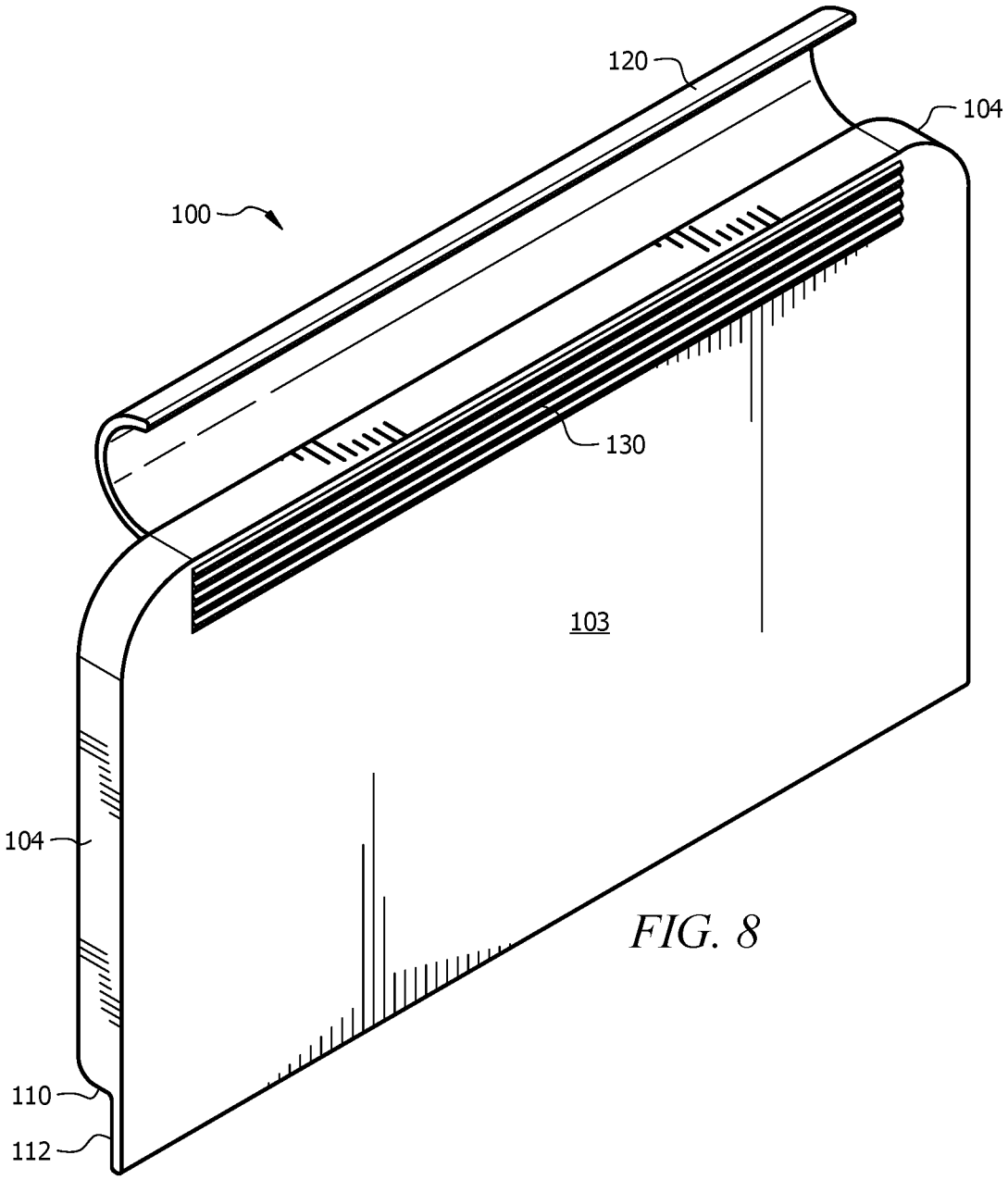
FIG. 8 illustrates another perspective view of a device for catching debris from a countertop according to an embodiment of the disclosure.

FIG. 6 illustrates a top view of the device 100 for catching debris from a countertop described above. FIG. 7 illustrates a bottom view of the device 100 for catching debris from a countertop described above. FIG. 8 illustrates another perspective view of the device 100 for catching debris from a countertop described above, showing the plurality of ridges 130 located on the back side 103 of the flat surface 102 and proximate to the handle 120.

Figure 9:
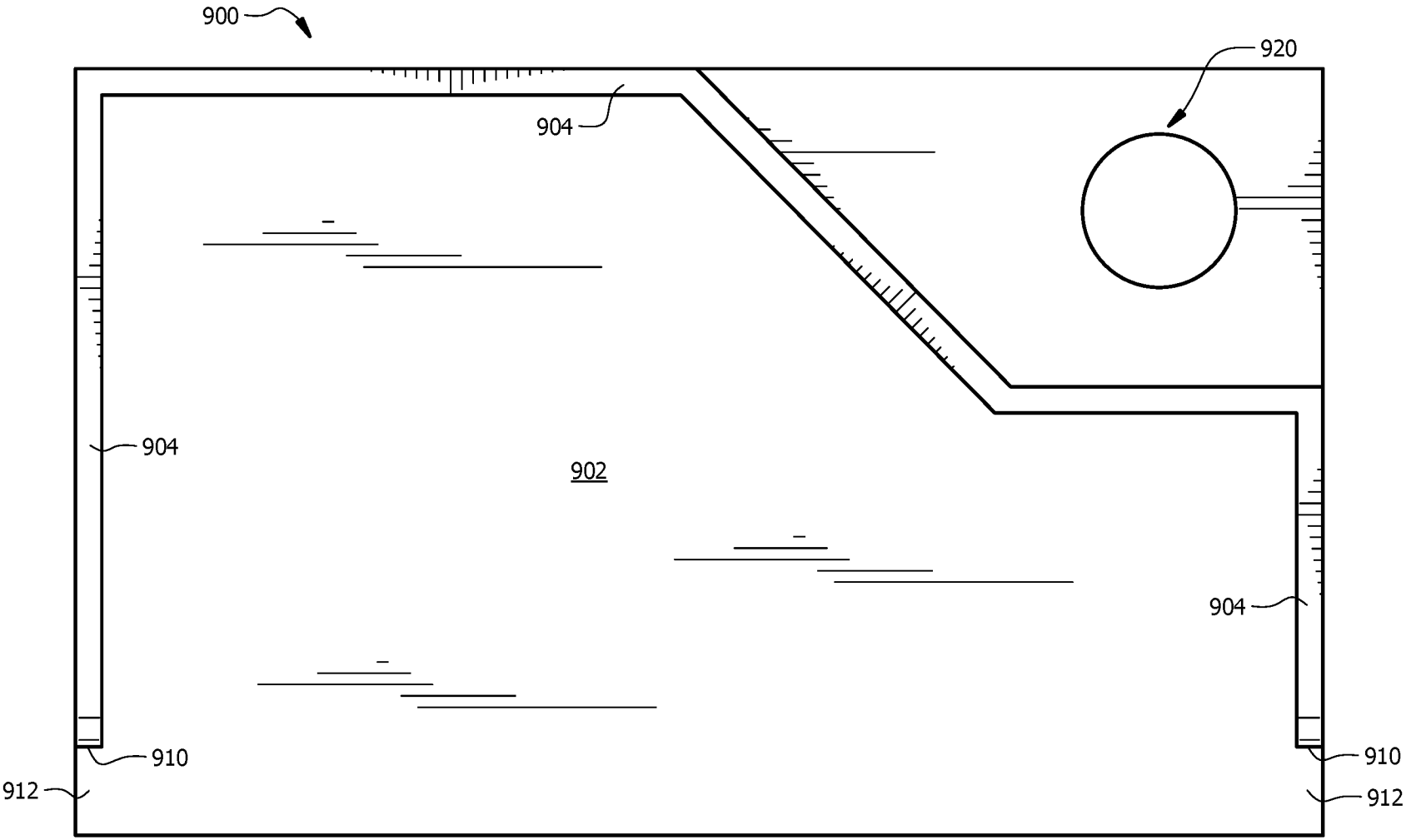
FIG. 9 illustrates a front view of another device for catching debris from a countertop according to an embodiment of the disclosure.

FIG. 9 illustrates a front view of another device 900 for catching debris from a countertop. The device 900 comprises a retaining wall 910 (which may be similar to the retaining wall 110) surrounding a flat surface 902 (which may be similar to the flat surface 102). The device 900 comprises a rigid counter guide 910, where a portion 912 of the flat surface 902 extends beyond the rigid counter guide 910. In the embodiment shown in FIG. 9, the handle 920 may comprise a cutout through the material of the device 900, and the handle 920 may be positioned off-set to one side of the flat surface 902. In some embodiments, the handle 920 may comprise an opening through the flat surface 902, where the retaining wall 904 may be positioned around the handle 920, such that any debris that is contained within the flat surface by the retaining wall 904 may not move toward the handle 920.

Embodiments of the disclosure may comprise one or more methods for manufacturing the device 100 and/or the device 900 as described above. A flat surface may be formed for supporting debris. A retaining wall may be attached to and/or incorporated onto at least a portion of the outer edge of the flat surface, where the retaining wall may extend perpendicular to the flat surface. A rigid counter guide may be formed at an end surface of the retaining wall. In some embodiments, at least a portion of the flat surface may extend past or beyond the rigid counter guide. A handle may be attached to and/or incorporated onto the flat surface and/or the retaining wall. The handle may be positioned on a side of the flat surface opposite the rigid counter guide, and the handle may be shaped to fit a hand of a user.

In some embodiments, the retaining wall may be attached to at least 50% of the outer edge of the flat surface. In some embodiments, the retaining wall may be attached to three of four sides of the flat surface. In some embodiments, a plurality of ridges may be formed onto a back side of the flat surface, proximate to the handle, where the ridges may be configured to provide grip for a user's fingers. In some embodiments, the rigid counter guide may be formed by forming a first counter guide located on a first side of the flat surface, and forming a second counter guide located on a second side of the flat surface.

Having described various devices and methods herein, exemplary embodiments or aspects can include, but are not limited to:

In a first embodiment, a device for catching debris may comprise a flat surface for holding debris; a retaining wall surrounding the flat surface and extending vertically from the flat surface, configured to restrict movement of the debris beyond portions of the flat surface; a rigid counter guide configured to fit against a countertop while at least a portion of the flat surface extends below the countertop, wherein the rigid counter guide allows a user to push the retaining wall and the portion of the flat surface against the countertop; and a handle attached to the flat surface at an opposite end from the rigid counter guide, wherein the handle is shaped to fit a hand of a user.

A second embodiment can include the device of the first embodiment, further comprising a plurality of ridges located on a back side of the flat surface, proximate to the handle, configured to provide grip for a user's fingers.

A third embodiment can include the device of the second embodiment, wherein a ridge of the plurality of ridges is approximately 4 millimeters.

A fourth embodiment can include the device of any of the first through third embodiments, wherein the rigid counter guide is formed by an end surface of the retaining wall.

A fifth embodiment can include the device of any of the first through fourth embodiments, wherein the retaining wall extends at least 10 millimeters from the flat surface.

A sixth embodiment can include the device of any of the first through fifth embodiments, wherein the flat surface extends at least 10 millimeters past the rigid counter guide.

A seventh embodiment can include the device of the sixth embodiment, wherein the rigid counter guide comprises a thickness of at least 3 millimeters.

An eighth embodiment can include the device of any of the first through seventh embodiments, wherein the rigid counter guide comprises a first counter guide located on a first side of the flat surface, and a second counter guide located on a second side of the flat surface.

A ninth embodiment can include the device of any of the first through eighth embodiments, wherein the portion of the flat surface extends below the countertop at least 5 millimeters.

A tenth embodiment can include the device of any of the first through ninth embodiments, wherein the portion of the flat surface extends below the countertop at least 10 millimeters.

In an eleventh embodiment, a method of manufacturing a device for catching debris from a countertop may comprise forming a flat surface for supporting debris; attaching a retaining wall to at least a portion of the outer edge of the flat surface, extending perpendicular to the flat surface; forming a rigid counter guide at an end surface of the retaining wall, wherein at least a portion of the flat surface extends past the rigid counter guide; attaching a handle to the flat surface or retaining wall at an opposite end from the rigid counter guide, wherein the handle is shaped to fit a hand of a user.

A twelfth embodiment can include the method of the eleventh embodiment, wherein attaching the retaining wall to at least a portion of the outer edge of the flat surface comprises attaching the retaining wall to at least 50% of the outer edge of the flat surface.

A thirteenth embodiment can include the method of the eleventh or twelfth embodiment, wherein attaching the retaining wall to at least a portion of the outer edge of the flat surface comprises attaching the retaining wall to three of four sides of the flat surface.

A fourteenth embodiment can include the method of any of the eleventh through thirteenth embodiments, further comprising forming a plurality of ridges on a back side of the flat surface, proximate to the handle, configured to provide grip for a user's fingers.

A fifteenth embodiment can include the method of any of the eleventh through fourteenth embodiments, wherein forming the rigid counter guide comprises forming a first counter guide located on a first side of the flat surface, and forming a second counter guide located on a second side of the flat surface.

In a sixteenth embodiment, a device for catching debris from a countertop may comprise a flat surface comprising an approximately rectangular shape; a retaining wall extending from at least three of four sides of the flat surface and extending perpendicular to the flat surface, configured to prevent debris from moving beyond the flat surface; a first rigid counter guide located at an end surface of the retaining wall, wherein at least a portion of the flat surface extends past the first rigid counter guide; and a second rigid counter guide located at another end surface of the retaining wall, wherein at least a portion of the flat surface extends past the second rigid counter guide.

A seventeenth embodiment can include the device of the sixteenth embodiment, wherein the first rigid counter guide and the second rigid counter guide are configured to fit against a countertop while the portion of the flat surface extends below the countertop.

A eighteenth embodiment can include the device of the sixteenth or seventeenth embodiments, further comprising a handle attached to the retaining wall, located between the first rigid counter guide and the second rigid counter guide.

A nineteenth embodiment can include the device of the eighteenth embodiment, further comprising a plurality of ridges located on a back side of the flat surface, proximate to the handle, configured to provide grip for a user's fingers.

A twentieth embodiment can include the device of any of the sixteenth through eighteenth embodiments, wherein the portion of the flat surface extends at least 5 millimeters past the first rigid counter guide and the second rigid counter guide.

What is claimed is:

1. A device for catching debris, the device comprising:

a flat surface for holding debris, wherein the flat surface comprises a plurality of ridges located on a back side of the flat surface, proximate to the handle, configured to provide grip for a user's fingers;

a retaining wall surrounding the flat surface and extending vertically from the flat surface, configured to restrict movement of the debris beyond portions of the flat surface;

a rigid counter guide configured to fit against a countertop while at least a portion of the flat surface extends below the countertop, wherein the rigid counter guide allows a user to push the retaining wall and the portion of the flat surface against the countertop; and a handle attached to the flat surface at an opposite end from the rigid counter guide, wherein the handle is shaped to fit a hand of a user.

2. The device of claim 1, wherein a ridge of the plurality of ridges is approximately 4 millimeters.

3. The device of claim 1, wherein the rigid counter guide is formed by an end surface of the retaining wall.

4. The device of claim 1, wherein the retaining wall extends at least 10 millimeters from the flat surface.

5. The device of claim 1, wherein the flat surface extends at least 10 millimeters past the rigid counter guide.

6. The device of claim 1, wherein the rigid counter guide comprises a thickness of at least 3 millimeters.

7. The device of claim 1, wherein the rigid counter guide comprises a first counter guide located on a first side of the flat surface, and a second counter guide located on a second side of the flat surface.

8. The device of claim 1, wherein the portion of the flat surface extends below the countertop at least 5 millimeters.

9. The device of claim 1, wherein the portion of the flat surface extends below the countertop at least 10 millimeters.

10. A method of manufacturing a device for catching debris from a countertop, the method comprising:

forming a flat surface for supporting debris;

forming a plurality of ridges on a back side of the flat surface, proximate to the handle, configured to provide grip for a user's fingers;

attaching a retaining wall to at least a portion of the outer edge of the flat surface, extending perpendicular to the flat surface;

forming a rigid counter guide at an end surface of the retaining wall, wherein at least a portion of the flat surface extends past the rigid counter guide;

attaching a handle to the flat surface or retaining wall at an opposite end from the rigid counter guide, wherein the handle is shaped to fit a hand of a user.

11. The method of claim 10, wherein attaching the retaining wall to at least a portion of the outer edge of the flat surface comprises attaching the retaining wall to at least 50% of the outer edge of the flat surface.

12. The method of claim 10, wherein attaching the retaining wall to at least a portion of the outer edge of the flat surface comprises attaching the retaining wall to three of four sides of the flat surface.

13. The method of claim 10, wherein forming the rigid counter guide comprises forming a first counter guide located on a first side of the flat surface, and forming a second counter guide located on a second side of the flat surface.

14. A device for catching debris from a countertop, the device comprising:

a flat surface comprising an approximately rectangular shape;

a plurality of ridges located on a back side of the flat surface, proximate to the handle, configured to provide grip for a user's fingers;

a retaining wall extending from at least three of four sides of the flat surface and extending perpendicular to the flat surface, configured to prevent debris from moving beyond the flat surface;

a first rigid counter guide located at an end surface of the retaining wall, wherein at least a portion of the flat surface extends past the first rigid counter guide; and a second rigid counter guide located at another end surface of the retaining wall, wherein at least a portion of the flat surface extends past the second rigid counter guide.

15. The device of claim 14, wherein the first rigid counter guide and the second rigid counter guide are configured to fit against a countertop while the portion of the flat surface extends below the countertop.

16. The device of claim 14, further comprising a handle attached to the retaining wall, located between the first rigid counter guide and the second rigid counter guide.

17. The device of claim 14, wherein the portion of the flat surface extends at least 5 millimeters past the first rigid counter guide and the second rigid counter guide.

* * * * *